United States Patent [19]

Rattray et al.

[11] Patent Number: 4,645,183

[45] Date of Patent: Feb. 24, 1987

[54] ADJUSTABLE ENCLOSURE

[75] Inventors: Thomas Rattray; John D. Osher, both of Cincinnati, Ohio

[73] Assignee: Gerber Products Company, Fremont, Mich.

[21] Appl. No.: 536,209

[22] Filed: Sep. 29, 1983

Related U.S. Application Data

[63] Continuation-in-part of Ser. No. 434,717, Oct. 15, 1982, abandoned.

[51] Int. Cl.[4] ..... F16C 11/00

[52] U.S. Cl. ..... 256/25; 256/26

[58] Field of Search ..... 256/25, 26, 23, 24; 403/97

[56] References Cited

U.S. PATENT DOCUMENTS

| | | | |
|---|---|---|---|
| 538,318 | 4/1895 | Brown et al. . | |
| 913,075 | 2/1909 | Villard . | |
| 1,168,836 | 1/1916 | Vette . | |
| 1,330,404 | 2/1920 | Sommer . | |
| 2,011,528 | 8/1935 | Seay . | |
| 2,361,853 | 10/1944 | Lundquist | 403/146 X |
| 2,477,438 | 7/1949 | Brouwer | 403/97 X |
| 2,709,073 | 5/1955 | Dougherty | 256/24 |
| 2,835,223 | 5/1958 | Erickson . | |
| 2,895,717 | 7/1959 | De Falco . | |
| 3,339,213 | 9/1967 | Spencer | 256/25 X |
| 3,469,822 | 9/1969 | O'Brien | 256/25 |
| 3,545,786 | 12/1970 | Yoder | 403/97 X |
| 3,767,167 | 10/1973 | Rasmussen . | |
| 4,299,507 | 11/1981 | Collins . | |

*Primary Examiner*—Cornelius J. Husar
*Assistant Examiner*—Joseph A. Fischetti
*Attorney, Agent, or Firm*—Townsend and Townsend

[57] ABSTRACT

An adjustable enclosure is provided for young children including a plurality of inner panels and a pair of end panels formed of tubes connected in a rectangular shape with a section of mesh material extending therebetween. The panels are connected in pivotal relation by hinge means designed to articulate approximately 300° allowing the panels to be folded together compactly for easy transport, an also to resist pivotal motion to a degree whereby young children cannot readily pivot one panel relative to another.

17 Claims, 16 Drawing Figures

ADJUSTABLE ENCLOSURE

RELATED APPLICATIONS

This is a continuation-in-part of U.S. patent application Ser. No. 434,717 filed Oct. 15, 1982, entitled Adjustable Enclosure now abandoned.

FIELD OF THE INVENTION

This invention relates generally to the area of portable enclosures, and, more particularly, to a multi-panel adjustable enclosure for retaining crawling age children in a confined area.

BACKGROUND OF THE INVENTION

Portable playpens for crawling age children are in widespread use. It is generally desirable to confine a young child in an enclosed play area at certain times both for the safety of the child and for the protection of articles in the room. This is particularly true when visiting another's dwelling which is strange to the child. Most portable playpen designs include a base having legs at each corner, and four vertically upstanding side walls typically formed of spaced bars disposed in a rectangular shape with a mesh material therebetween. In most prior art playpens, the bottom section and side walls are hinged so that the playpen may be folded in half for transport.

The major disadvantage of known playpen designs is that they are heavy and bulky making them difficult to transport in a vehicle or from one room to another. Many currently available portable playpens are simply too big to fit into the trunks of compact cars, or too heavy to be conveniently carried from house to car.

It is therefore an object of this invention to provide an enclosed play area for crawling age children which is portable, light weight and foldable into a small, easily transportable size.

It is another object of this invention to provide a multi-panel enclosed play area for children which is adapted to be arranged in virtually any configuration to conform to the dimensions and space of a room.

It is still another object of this invention to provide a multi-panel enclosure in which the panels are connected by hinge means adapted to articulate the panels in a relatively stiff or restricted manner so that small children may not pivot one panel relative to another and escape from the enclosure.

It is a further object of this invention to provide a multi-panel enclosed play area for young children which is relatively inexpensive to manufacture.

SUMMARY OF THE INVENTION

These and other objects are accomplished in this invention of an adjustable enclosure forming a play area for young children comprising a plurality of panels pivotally connected by hinge means. Each of the panels includes an upper and lower horizontal tube disposed between spaced vertical tubes with flexible mesh material extending therebetween. The hinge means include hinging elements formed at each end of the upper tubes of adjacent panels, which are adapted to engage one another so that adjacent panels may be pivoted through approximately a 300° angle. The pivotal motion permitted by the hinge means enables the enclosure to assume virtually any shape, and permits adjacent panels to be folded together into a lightweight, compact unit for easy transport. The hinge means also include means for mounting the hinging elements to the vertical tubes of each panel so that the pivoting action of adjacent panels is relatively stiff. The hinging elements are specifically designed in this manner so as to assure that young children may not readily move the panels and escape from the enclosure. Various embodiments of the hinge means of this invention for creating such relatively stiff pivotal motion are illustrated.

DESCRIPTION OF THE DRAWINGS

The structure, operation and advantages of this invention will become apparent upon consideration of the following description taken in conjunction with the accompanying drawings wherein.

DETAILED DESCRIPTION OF THE INVENTION

Figure 1:
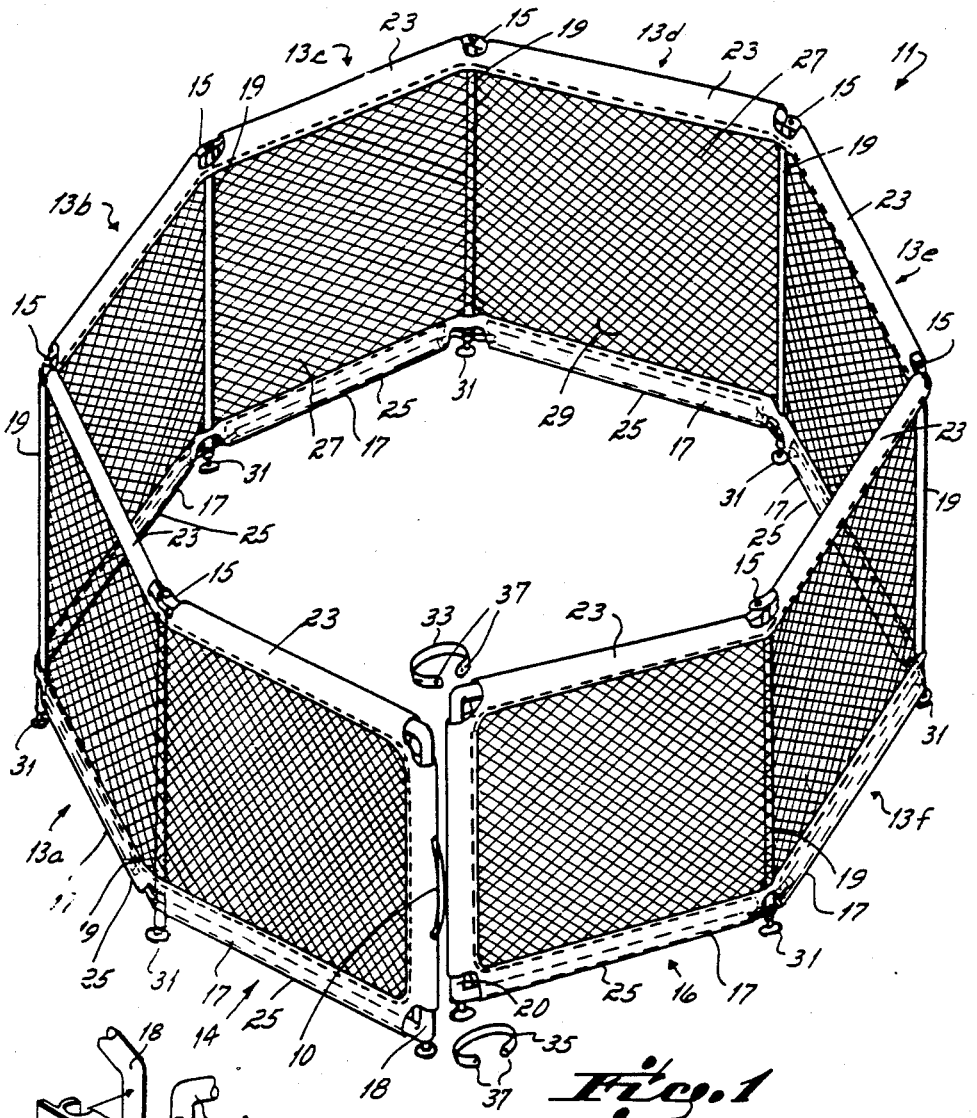
FIG. 1 is an isometric view of the assembled multi-panel enclosure of this invention.

Referring now to the drawings and in particular to FIG. 1, the children's enclosure of this invention is shown and labeled generally with a reference numeral 11. The embodiment of enclosure 11 shown in FIG. 1 comprises a pair of end panels 14, 16 and six inner or intermediate panels 13*a–f* disposed between the end panels 14, 16. Other numbers of panels could be utilized to form the enclosure 11, and an eight-panel unit is shown in the drawings for purposes of discussion only.

Each inner panel 13*a–f* includes a horizontal upper tube 15 and lower tube 17 which extend between spaced vertical tubes 19. The vertical tubes 19 are each common to two adjacent inner panels 13*a–f* as shown in FIG. 1. End panels 14, 16 share a vertical tube 19 in common with the inner panels 13*a* and 13*f*, respectively, but also include separate vertical tubes 18, 20 at their opposite ends. Adjacent panels 13*a–f*, 14 and 16 are pivotally connected at their upper horizontal tubes 15 so that they each may be pivoted through an angle of about 300° and folded together in a compact unit as discussed in detail below. The end panels 14, 16 include a carrying strap 10 for transporting the enclosure 11 with the panels 13*a–f*, 14, 16 in the folded position.

Figure 1B:
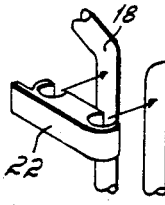
FIG. 1*b* is a schematic front view of an alternate means of securing the end panels of the enclosure together.
Figure 1A:
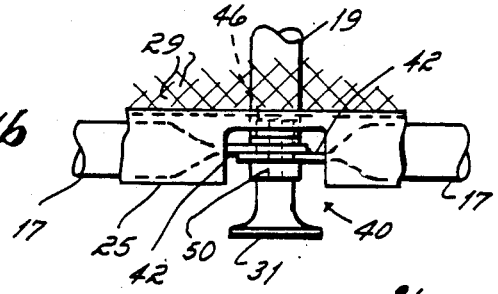
FIG. 1*a* is an enlarged front view of the base of the vertical tube of a panel.

Each panel 13*a–f*, 14 and 16 includes an upper sleeve 23 encasing the upper tubes 15, and a lower sleeve 25 encasing the lower tubes 17. Upper and lower sleeves 23, 25 may be formed of vinyl, cloth or any other suitable fabric material. As shown in FIG. 1*a*, the lower sleeves 25 encase both the lower tubes 17 and the vertical tubes 19 so as to be essentially continuous from end panel 14 to end panel 16. The same is true for upper sleeves 23 which encase the upper tubes 15. The lower sleeves 25 may be extended, if desired, so that the fabric material nearly touches the floor to protect a child in the enclosure 11 from drafts and prevent toys from escaping the enclosure 11. A section of mesh material 27 is attached between the upper and lower sleeves 23, 25 and to the vertical tubes 19 of panels 13*a–f* and vertical tubes 18, 20 of end panels 14, 16. The mesh 27 may be formed of nylon, cord or any other suitable material, and preferably has openings 29 which are small enough to avoid catching young children's fingers. As shown in FIG. 1*a*, the base of the vertical tubes 18, 19, 20 is provided with a friction member 31 which may take the form of a suction cup or any other suitable friction element which will resist movement either on a smooth floor such as tile or on a carpeted surface.

As mentioned above, end panels 14 and 16 have a vertical tube 19 in common with adjacent inner panels 13*a*,13*f*, but also include a separate vertical tube 18 and 20, respectively at the opposite end. Vertical tubes 18, 20 are not connected together by hinge means and this enables enclosure 11 to be positioned to assume virtually any configuration depending on the dimensions or available space in a room. For example, the end panels 14, 16 may be completely separated and the enclosure 11 placed adjacent a wall so that end panels 14, 16 abut the wall. In this manner, the enclosure 11 is essentially three-sided with the wall being used as a fourth side to provide a completely enclosed area. Alternately, the end panels 14, 16 are provided with upper and lower straps 33, 35 having snaps 37 so that the end panels 14, 16 may be secured together to form a completely self-contained enclosure 11. Straps 33, 35 extend between the vertical tubes 18, 20 of end panels 14, 16 and may be readily snapped together by an adult but not a young child. Vertical tubes 18, 20 may also be connected by clips 22, as shown in FIG. 1*b*. It should be understood that while enclosure 11 is shown in FIG. 1 as having a regular octagon shape, formed with six panels 13*a–f* and two end panels 14, 16, other numbers of panels may be utilized and the panels may be pivoted as desired to form enclosure 11 in a variety of shapes according to the requirements of a particular room.

Referring now to FIGS. 2–9, various embodiments of the hinge means which pivotally connect adjacent panels are shown. As mentioned above, the hinge means herein is designed to enable adjacent panels 13*a–f*, 14 and 16 to pivot relative to one another through an angle of approximately 300°. This range of pivoting motion between adjacent panels enables the enclosure 11 to assume a variety of shapes, and also permits the panels to be folded together beginning from one end panel 14 or 16 to the other for easy transport. In addition, the hinge means of this invention are adapted to pivot in a relatively stiff or resistive manner so that a young child cannot readily pivot one panel 13*a–f*, 14 or 16 relative to another. This is particularly important where the end panels 14, 16 are not connected by straps 33, 35 but are placed in a position abutting a wall of a room. The stiff hinging action of the hinge means herein prevents a child from pivoting either end panel 14 or 16 outwardly and escaping from enclosure 11.

Figure 2:
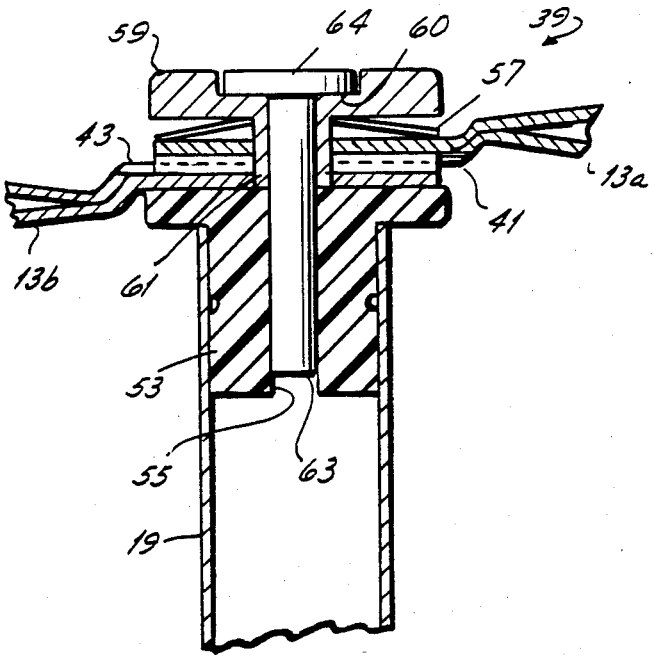
FIG. 2 is an enlarged view in partial cross-section of one embodiment of the hinge means herein.
Figure 3:
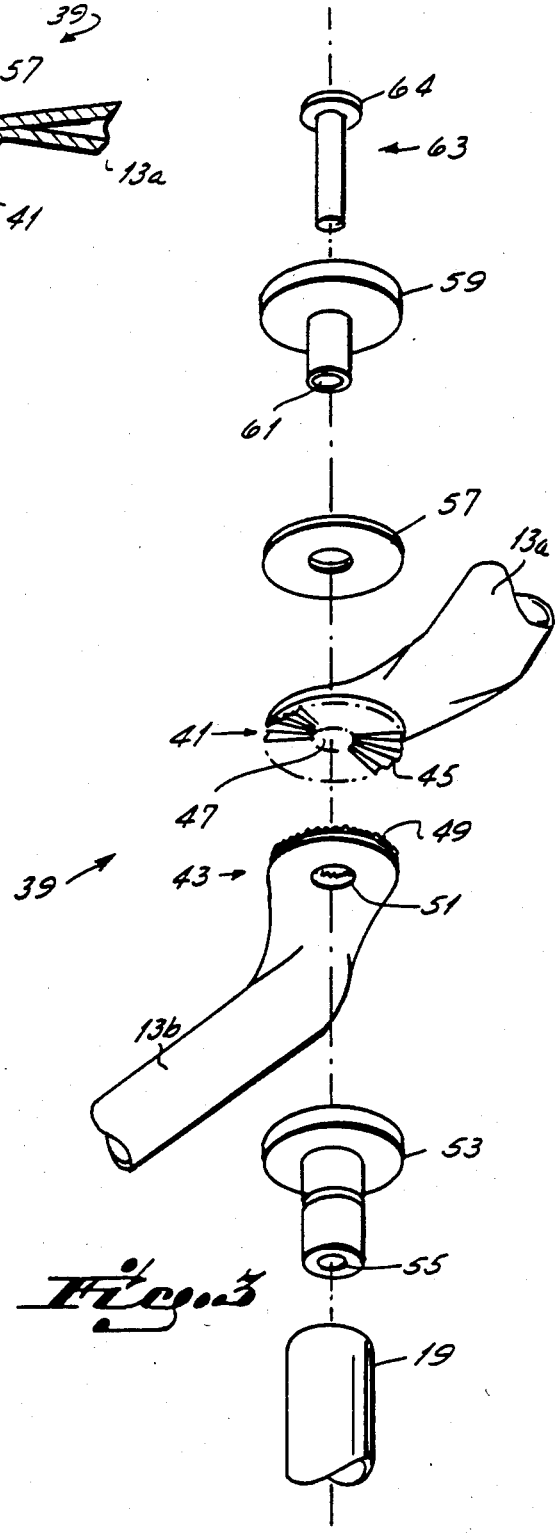
FIG. 3 is an exploded view of the hinge means shown in FIG. 2.

Referring now to FIGS. 2 and 3, one embodiment of the hinge means of this invention is shown and labeled 39. Hinge means 39 includes a hinging element 41 formed at each end of the upper tubes 15 of alternating inner panels 13*a–f*, and a hinging element 43 formed at each end of the upper tubes 15 of the remaining inner panels 13*a–f*. For purposes of the present discussion, inner panels 13 *a, c, e* are formed with hinging element 41 and inner panels 13 *b, d, f* are formed with hinging element 43. Assuming such a configuration of inner panels 13*a–f*, one end of the upper tube 15 of end panel 14 is formed with a hinging element 43 and one end of the upper tube 15 of end panel 16 is formed with a hinging element 41. Although a distinction is made for purposes of the present discussion between hinging elements 41, 43, it is contemplated that the production form of hinging elements 41, 43 will be identical and upper tubes 15 of any inner panels 13*a–f* would be interchangeable as will become apparent below.

Hinging element 41 includes a radially ribbed surface 45 having a central bore 47, and hinging element 43 has an identical radially ribbed surface 49 with a central bore 51. In one embodiment, these surfaces 45, 49 are formed by flattening the ends of horizontal upper tubes 15 of each inner panel 13*a–f* and then stamping them with a radially ribbed coining die. The upper tubes 15 of end panels 14, 16 are formed with only one radially crimped end for engagement with the adjoining inner panels 13*a*, 13*f*, respectively. The other end of upper tubes 15 of end panels 14, 16 are formed with a smooth finish. Alternately, the ribbed surfaces 49 may be formed of plastic by injection molding as described in more detail in connection with FIGS. 12 and 13.

As shown in FIG. 2, the pivot point between adjacent panels 13 *a–f*, 14, 16 is at the vertical tubes 19. Considering the hinge means 39 at the joint between inner panels 13*a* and 13*b*, for example, the hinging element 41 of panel 13*a* is disposed above and into engagement with the hinging element 43 of panel 13*b* such that their central bores 47, 51 align. To connect the hinging elements 41, 43 to vertical tube 19 and thus form the completed hinge means 39, a tube fitting 53 having a central bore 55 is press fit into the top of vertical tube 19. Hinging elements 41, 43 are placed over the tube fitting 53 such that their central bores 47, 51 align with the central bore 55 of tube fitting 53. A Belleville spring washer 57 is placed over upper hinging element 41 and an end cap 59 having a hollow stem 61 is inserted through the spring washer 57 and the central bores 47, 51 of hinging elements 41, 43, respectively, into engagement with the upper surface of tube fitting 53. The entire assembly is then secured together by a rivet 63 which extends downwardly through the end cap 59, spring washer 57, hinge elements 41, 43 and into tube fitting 53. To avoid sharp edges, the end cap 59 is provided with a seat 60 to receive the head 64 of the rivet 63 so that the head 64 is flush with the top surface of end cap 59.

The ribbed surfaces 45, 49 of hinging elements 41, 43 are adapted to engage and articulate relative to one another over an angle of approximately 300°. The spring washer 57 acts as a spring means urging the ribbed surfaces 45, 49 of hinging means 41, 42 together so that pivotal motion therebetween is relatively stiff, requiring a force greater than ordinarily found in most hinges. This is to assure that adjacent panels 13 may not be rotated by a force which a young child might apply.

As shown in FIG. 1*a*, the lower tubes 17 of panels 13*a–f*, 14 and 16 are formed with hinge means 40 for articulation relative to vertical tubes 19. Preferably, the hinge means 40 dispose the lower horizontal tubes 17 about three inches from the floor so as to eliminate the possibility of the lower tubes 17 accidentally choking a young child. The hinge means 40 of lower tubes 17 are similar to hinge means 39 described above, except that friction between the hinging elements is to be kept to a minimum for the hinge means 40. Accordingly, each end of the lower tube 17 of all inner panels 13*a–f* and one end of the lower tube 17 of the end panels 14, 16 are formed with an identical hinging element 42. Hinging element 42 is a smooth surface having a central bore, which is formed by crimping the ends of lower tubes 17 in this embodiment of the invention.

The hinging elements 42 of the lower tubes 17 of adjacent inner panels 13*a–f* are pivotally attached to each vertical tube 19 by means of a tube fitting 46 and a rivet 50 or other suitable fastener. The tube fitting 46 is press fit into the bottom of vertical tubes 19 and the hinging elements 42 of the lower tubes 17 of adjacent panels 13*a–f* are placed over the bottom of vertical tubes 19 so that their bores align with the tube fitting bore. The rivet 50 is then inserted through the bores of hinging elements 42 and into tube fitting 46, allowing lower tubes 17 of adjacent panels 13*a–f* to readily pivot about the vertical tubes 19.

Figure 4:
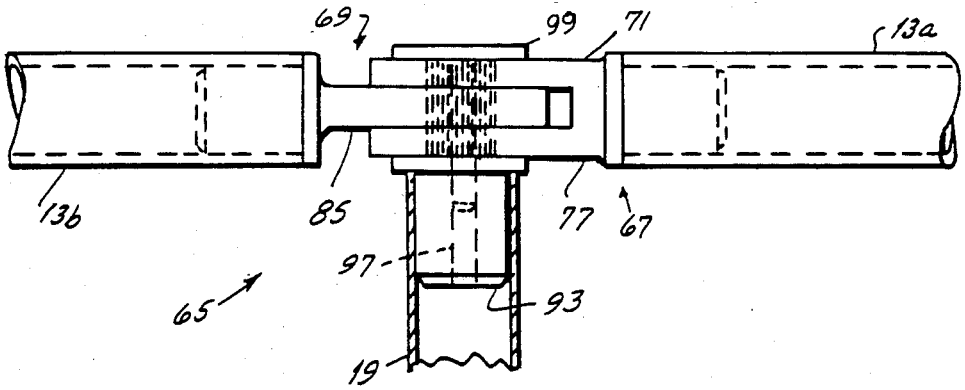
FIG. 4 is an enlarged view in partial cross-section of an alternate embodiment of the hinge means of this invention.
Figure 5:
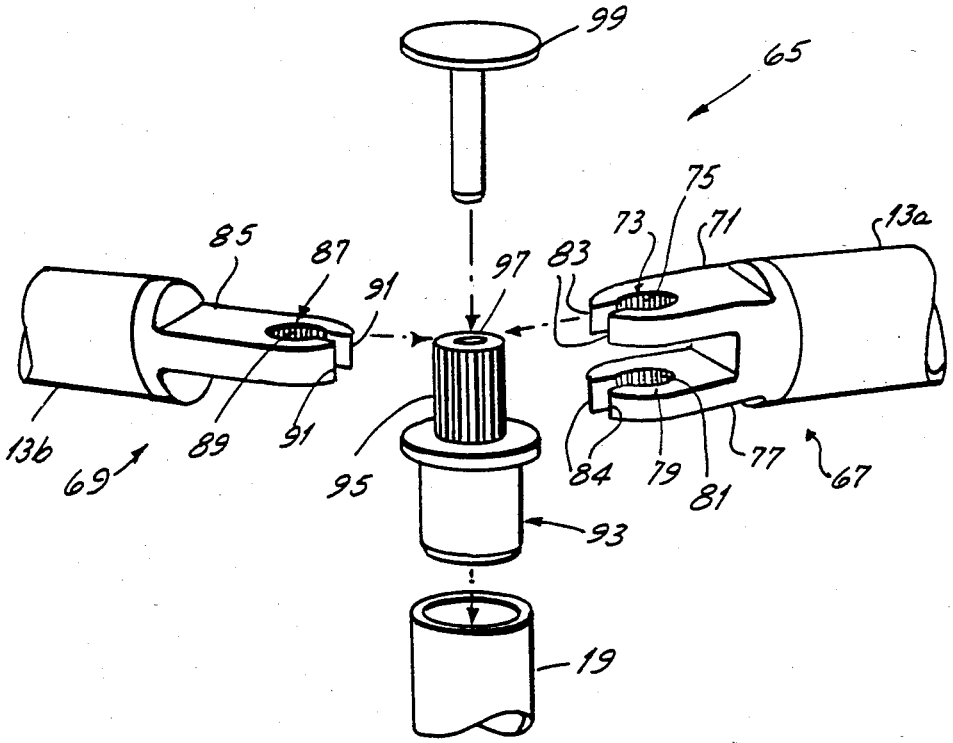
FIG. 5 is an exploded view of the hinge means in FIG. 4.

An alternate embodiment of the hinge means herein is shown in FIGS. 4 and 5 and labeled with the reference numeral 65. In this embodiment, one end of the upper tube 15 of each panel 13*a–f* receives a two pronged insert 67 which is press fit therein. A single pronged insert 69 is press fit in the other end of upper tubes 15. As shown in FIG. 5, the two pronged insert includes an upper extension 71 having an open center 73 with a circumference formed with serrations 75. Disposed beneath and in alignment with upper extension 71 is a lower extension 77 also having an open center 79 formed with circumferential serrations 81. Both the upper and lower extensions 71, 77 include a cut-out portion forming spaced edge sections 83, 84, respectively, extending into their open centers 73, 79. The two pronged insert 67 is made of a resilient material such as nylon, celcon and the like.

The single pronged insert 69 press fitted into the other end of upper tubes 15 includes one central extension 85 having an open center 87 with circumferential serrations 89. The central extension 85 includes a cut-out forming spaced edge sections 91 extending into the open center 87.

As shown in FIGS. 4 and 5, the upper tubes 15 of adjacent panels 13*a–f* are each formed with a two-pronged insert 67 at one end and a single-pronged insert 69 at the other. The panels 13*a, b*, for example, are oriented such that the upper tube 15 of panel 13*a* presents an insert 67 to the end of adjacent panel 13*b* having insert 69 for pivotal connection to a common vertical tube 19. Depending on which insert 67 or 69 is presented to the adjacent end of the upper tubes 15 of end panels 14, 16, the end panels 14, 16 are provided with the mating insert 67 or 69.

To pivotally connect mating insert 67, 69 to a vertical tube 19 and form hinge means 65, a tube fitting 93 is provided having one end adapted to be press fitted into the vertical tubes 19 and the other end formed with an upwardly extending serrated stud 95. Tube fitting 93 is formed with a central bore 97 adapted to receive a rivet 99. As shown in FIG. 4, hinge means 65 is assembled by snapping the two pronged insert 67 onto the stud 95 by urging the spaced edge sections 83, 84 of its upper and lower extensions 71, 77 apart. The extension 85 of the single prong insert 69 is then snapped into place along stud 95 between the upper and lower extensions 71, 77 of the insert 67, by urging apart its spaced edge sections 91. Rivet 99 is then inserted into the central bore 97 of tube fitting 93 and engages the upper surface of upper extension 71 to hold the entire assembly in place.

As in the previous embodiment shown in FIGS. 2 and 3, this embodiment of hinge means 65 is adapted to pivot over approximately 300° but with a relatively stiff or resistive motion. The circumferential serrations formed in inserts 67, 69 engage the serrated stud 95 and resist articulation therebetween. The rivet 99 is tightened within tube fitting 93 to an extent that the engagement between the serrations of extensions 71, 77, 85 and the stud 95 are of a magnitude which could not normally be overcome by a small child. This assures that the panels 13*a–f*, 14 and 16 are not rotated relative to one another except by an adult.

Figure 6:
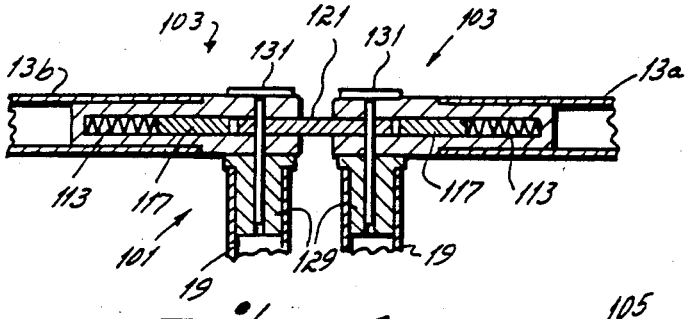
FIG. 6 is an enlarged view in partial cross-section of a further embodiment of the hinge means herein.
Figure 7:
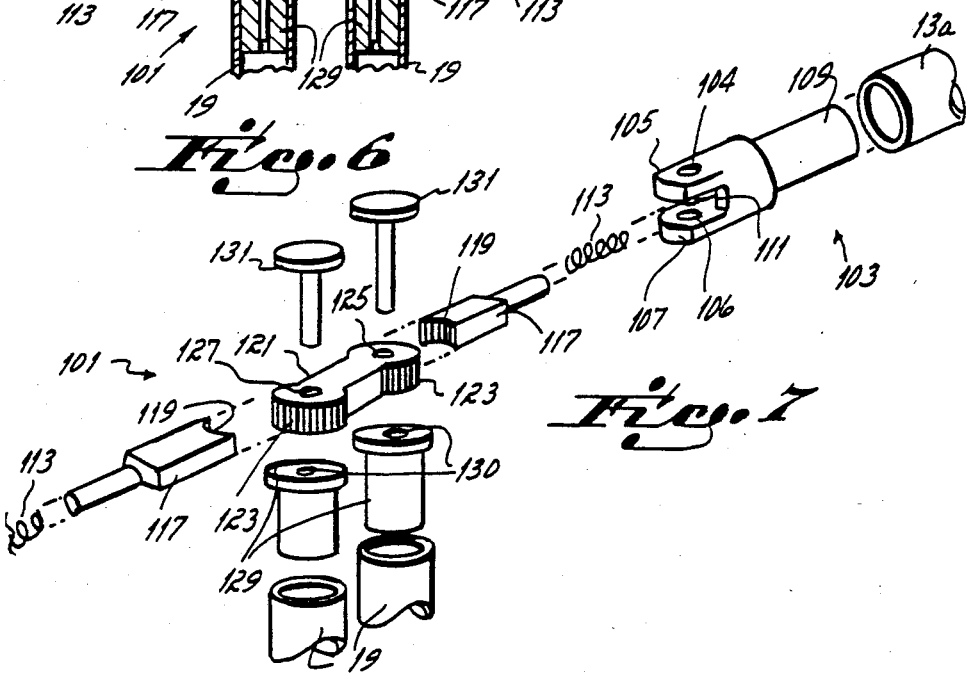
FIG. 7 is an exploded view of the hinge means shown in the FIG. 6 embodiment.

Referring now to FIGS. 6 and 7, a further embodiment of the hinge means herein is shown and labeled with the reference numeral 101. In this embodiment, each end of the upper tube 15 of inner panels 13*a–f* receives an insert 103 which is press fitted therein. The end of upper tubes 15 of end panels 14, 16 which adjoin panels 13*a* and 13*f*, respectively, are also provided with an insert 103. The insert 103 includes upper and lower outwardly extending lip sections 105, 107 each formed with a bore 104, 106 respectively. The upper and lower lip sections 105, 107, are connected to a tube 109 having a cavity 111. The tube 109 is adapted to be press fitted into each end of the upper tubes 15 of inner panels 13*a–f*, and into one end of the upper tubes 15 of end panels 14, 16.

The cavity 111 of tube 109 is adapted to receive a spring 113 and one end of a detent 117. The other end of detent 117 is formed with an outwardly extending serrated edge 119. The detent 117 is insertable within cavity 111 to a point where the serrated edge 119 thereof is disposed inwardly of the bores 104, 106 in upper and lower lip sections 105, 107, respectively.

As shown in FIGS. 6 and 7, this embodiment of the enclosure 11 differs from those described above in that each inner panel 13*a–f* includes separate vertical tubes 19 which are not common to adjacent panels 13*a–f*. The end panels 14, 16 also include a separate vertical tube 19 opposite their other separate vertical tubes 18, 20 respectively. To connect abutting vertical tubes 19 of adjacent panels 13*a–f*, a ratchet link 121 is provided. Ratchet link 121 includes circumferential serrations 123 formed at each end, and a pair of bores 125, 127 extending inwardly from the serrations 123. The ratchet link 121 is adapted to extend between the upper and lower lip sections 105, 107 of the inserts 103 which are press fitted into the upper tubes 15 of adjacent panels 13*a–f*. Once in position between the inserts 103 of adjacent panels 13*a–f*, the bores 125, 127 of ratchet link 121 align with the bores 104, 106 in each of the inserts 103. The vertical tubes 19 of each adjacent panel 13*a–f* are adapted to receive a tube insert 129 formed with a central bore 130. As shown in the drawings, to assemble the hinge means 101 of this embodiment between inner panels 13*a*, 13*b*, for example, the ratchet link 121 is disposed between the upper and lower lip sections 105, 107 of inserts 103 secured in the adjoining ends of upper tubes 15 of panels 13*a, b*. In this position, the bores 104, 106 of insert 103 in panel 13*a* align with the bore 125 of ratchet link 121 and the bores 104, 106 of insert 103 in panel 13*b* align with bore 127 in ratchet 121. In turn, such bores of each panel 13*a, b* align with the central bore 130 of tube insert 129 disposed in their respective vertical tubes 19. A rivet 131 is then inserted through each set of aligning bores into the tube inserts 129 for securing the entire hinge means 101 together.

In the assembled position, as shown in FIG. 6, the ratchet link 121 is positioned relative to detent 117 so that their serrations 123, 119, respectively, are in engagement. The spring 113 biases the detent 117 into contact with the ratchet link 121 so that relative rotation between panels 13*a* and 13*b* is resisted. As in the prior embodiments, hinge means 101 thus assures that a young child will not be able to rotate adjacent panels 13 to exit from enclosure 11.

Figure 8:
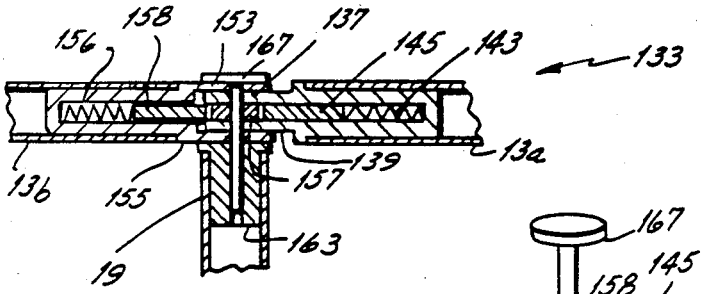
FIG. 8 is an assembly view in partial cross-section of a still further embodiment of the hinge means herein.
Figure 9:
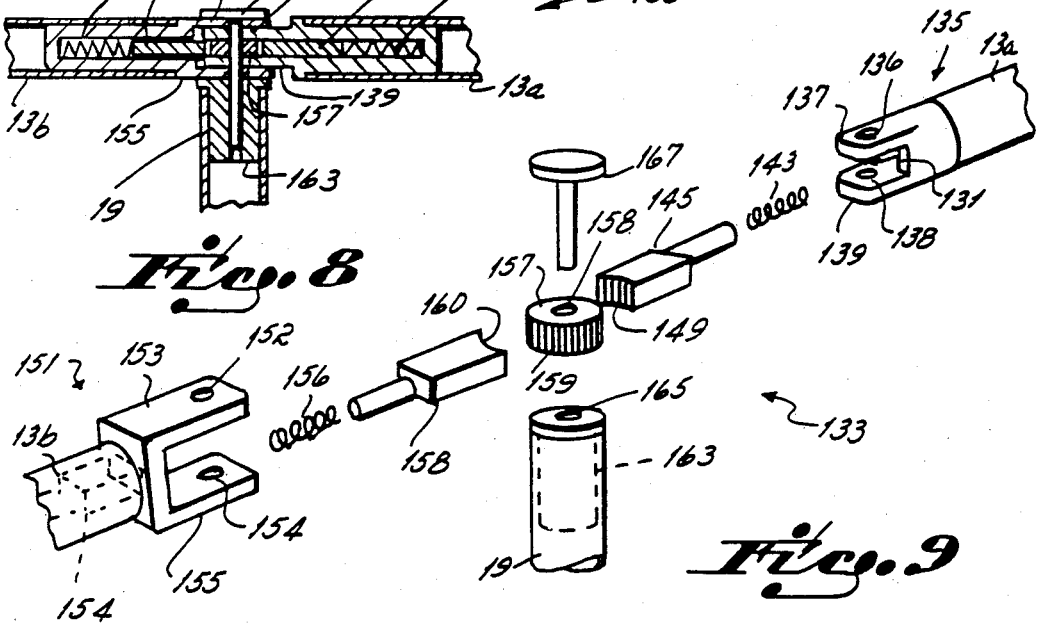
FIG. 9 is an exploded view of the embodiment of the hinge means shown in FIG. 8.

A still further embodiment of the hinge means of this invention is shown in FIGS. 8 and 9 labeled with the reference numeral 133. Hinge means 133 is a variation of hinge means 101 adapted for use with a single, vertical tube 19 shared in common by two adjoining inner panels 13*a–f* and end panels 14, 16 as in the embodiments of FIGS. 2–6. Hinge means 133 includes a first insert 135 having upper and lower lip sections 137, 139 formed with bores 136 and 138, respectively, which is press fitted into one end of the upper tubes 15 of each inner panel 13*a–f*. A cavity 131 is formed in first insert 135 which is adapted to receive a spring 143 and a detent 145. As in the embodiment in FIGS. 6 and 7, detent 145 includes an end insertable within cavity 141 and a serrated edge 149 formed on its opposite end.

Hinge means 133 further includes a second insert 151 adapted to be press fitted into the other end of the upper tube 15 of each panel 13*a–f*. Second insert 151 includes upper and lower lip sections 153, 155 having bores 152 and 154, respectively. A cavity 154 is formed in second insert 151 which is adapted to receive a spring 156 and one end of a detent 158. The other end of detent 158 is formed with a serrated edge 160. The inner panels 13*a–f* are oriented such that the upper tube 15 of adjacent panels 13*a–f* present a first and second insert 135, 151 to one another for pivotal connection to a common vertical tube 19. The end panels 14, 16 include an upper tube 15 formed with either a first or second insert 135, 151 at one end to mate with the first or second insert 135, 151 of an adjoining inner panel 13*a*, 13*f*. The first and second inserts 135, 151 of adjoining panels 13*a* and 13*b*, for example, are formed to engage one another such that the upper lip 153 of second insert 151 slides over the upper lip 137 of first insert 135, and the lower lip 155 of second insert 151 slides under the lower lip 139 of first insert 135. The space between upper and lower lips 137, 139 of first insert 135 is formed to receive a ratchet link 157 having a central bore 158 and serrations 159 formed along its entire circumference. The ratchet link 157 is adapted to engage the serrated edges 149, 160 of detents 145, 158 disposed in the cavities 141, 154 of the inserts 135, 151, respectively.

To assemble hinge means 133, the first and second inserts 135, 151 are placed in engagement as described above, with the ratchet link 157 disposed in the space formed by the lips 137, 139 of first insert 135. The assembly is then placed over a single vertical tube 19 having a tube fitting 163 press fitted therewithin, which fitting 163 is formed with a central bore 165. A rivet 167 is then inserted through the aligning bores and into engagement with the tube fitting 163. In the assembled position, the detents 145, 151 in each of the upper tubes 15 of adjacent panels 13*a–f*, 14, 16 are biased by springs 143, 156 into engagement with the ratchet link 157 so as to resist relative rotation between adjacent panels to an extent that young children are prevented from exiting enclosure 11.

Figure 10:
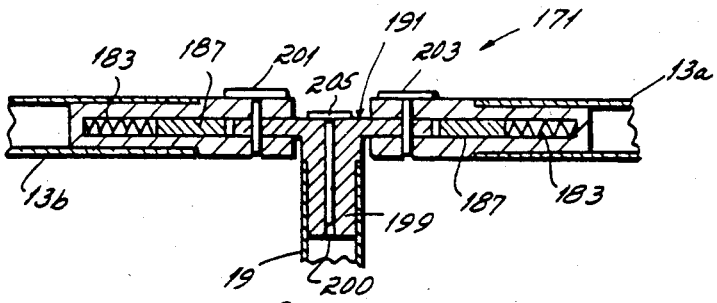
FIG. 10 is an enlarged view in partial cross-section of a variation of the embodiment of the hinge means of FIG. 6.
Figure 11:
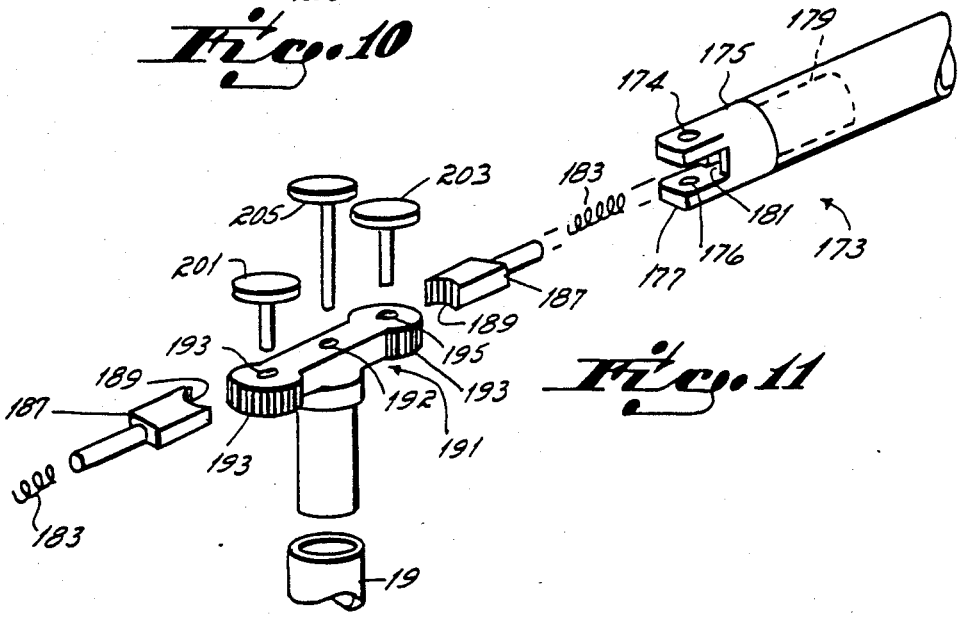
FIG. 11 is an exploded view of the assembly view of FIG. 10.

A still further variation of the hinge means 101 of FIGS. 6 and 7 is shown in FIGS. 10 and 11, and labeled with the reference numeral 171. Hinge means 171 adapts the configuration of hinge means 101 for connection to a single, common vertical tube 19 between adjacent panels 13*a–f*, 14, 16, and permits approximately 300° relative rotation between adjacent panels. Hinge means 133 of FIGS. 8, 9 limits relative rotation of adjacent panels 13*a–f*, 14, 16 to approximately 180°.

In this embodiment, each end of the upper tube 15 of inner panels 13*a–f* is adapted to receive an insert 173, and panels 13*a, b* are shown in FIGS. 10, 11 for purposes of illustration. The end of upper tubes 15 of end panels 14, 16 which adjoin panels 13*a* and 13*f*, respectively, are also provided with an insert 173. The insert 173 includes upper and lower outwardly extending lip sections 175, 177 each formed with a bore 174, 176 respectively. The upper and lower lip sections 175, 177, are each connected to a tube 179 having a cavity 181. The tube 179 is adapted to be press fitted into each end of the upper tubes 15 of inner panels 13*a–f*, and into one end of the upper tubes 15 of end panels 14, 16.

The cavity 181 of tubes 179 is adapted to receive a spring 183 and one end of a detent 187. The other end of detent 187 is formed with an outwardly extending serrated edge 189. The detent 187 is insertable within cavity 181 to a point where the serrated edge 189 thereof is disposed inwardly of the bores 174, 176 in upper and lower lip sections 175, 177, respectively.

Hinge means 171 further includes a ratchet link 191 for connecting the inserts 173 of adjacent panels 13*a, b* in pivotal relation to their common vertical tube 19. Ratchet link 191 includes circumferential serrations 193 formed at each end, a central bore 192 and a pair of outer bores 193, 195 extending inwardly from the serrations 193. The ratchet link 191 is adapted to extend between the upper and lower lip sections 175, 177 of inserts 173 in panels 13*a* and 13*b*, respectively, so that the outer bores 193, 195 of ratchet link 191 align with the bores 174, 176 in each of the inserts 173.

The vertical tube 19 between panels 13*a, b* is adapted to receive a tube insert 199 formed with a central bore 200. As shown in FIG. 10, hinge means 171 is assembled by disposing ratchet link 191 between the lip sections 175, 177 of inserts 173 in panels 13*a, b*, such that the central bore 192 of ratchet link 191 aligns with the bore 200 in tube insert 199. First and second rivets 201, 203 extend through the aligning bores 174, 176 of each insert 173 to secure them to the ratchet link 191. A longer, third rivet 205 is disposed through the central bore 192 of ratchet link 191 and extends downwardly into the bore 200 of tube insert 199 to secure the entire assembly to vertical tube 19.

As in the embodiment of FIGS. 6 and 7, the hinge means 171 is designed to prevent young children from rotating adjacent panels 13*a–f*, 14, 16. In the assembled position of hinge means 171, the ratchet link 191 is positioned relative to the detents 187 of each panel 13*a, b* so that the serrations 193 of ratchet link 191 engage the serrated edge 189 of detent 187. The spring 183 biases the detents 187 into continuous contact with the ratchet link 191 so that relative rotation between panels 13*a* and 13*b* is resisted.

Figure 12:
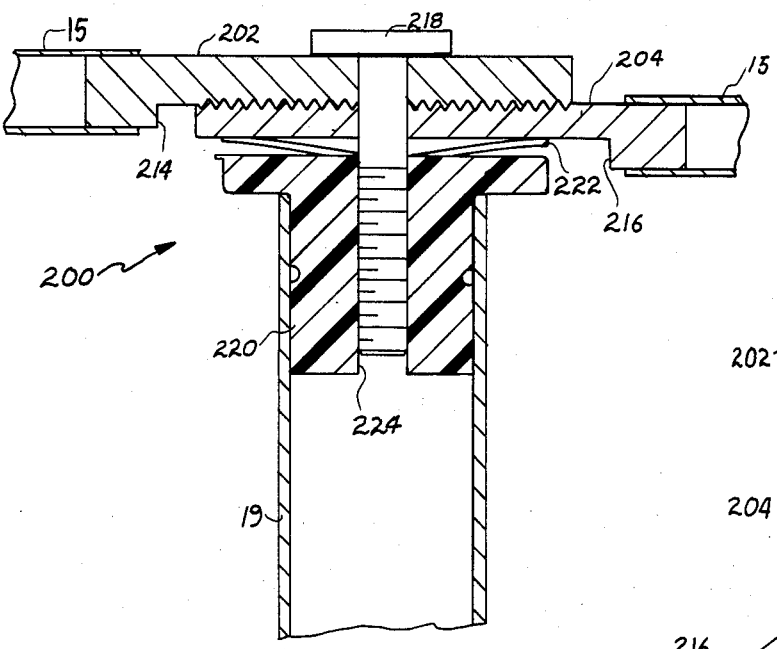
FIG. 12 is an enlarged view in partial cross section of still another embodiment of the hinge means of this invention.
Figure 13:
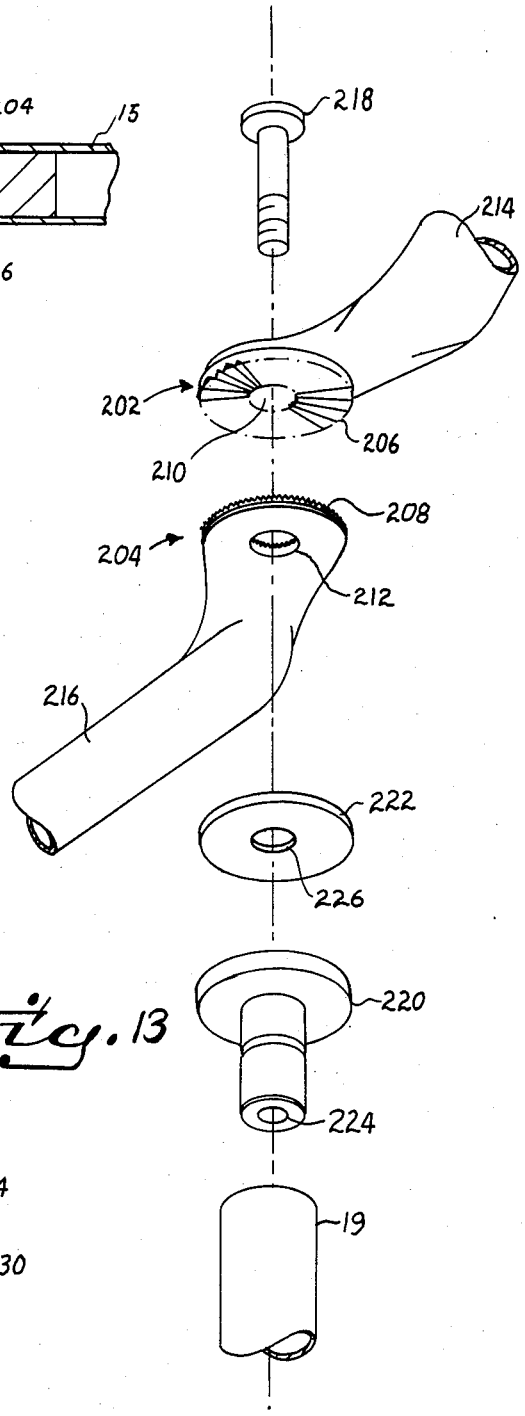
FIG. 13 is an exploded view of the hinge means shown in FIG. 12.

Referring now to FIGS. 12 and 13, still another embodiment of the hinge means of this invention is illustrated. Hinge means 200 comprises a hinging element 202 and a hinging element 204 press fit or staked into opposite ends of the upper tubes 15 of each panel 13*a–f*. The hinging elements 202, 204 are each formed with an identical radially ribbed surface 206 and 208, respectively, having central bores 210, 212. Preferably, the hinging elements are injection molded and formed of nylon or another suitable plastic material. The hinging elements 202, 204 are formed with stem portions 214, 216 which are adapted to be press fitted into upper tubes 15 and are offset from the ribbed surfaces 206, 208 so as to permit compact folding of the intermediate panels 13*a–f* and end panels 14, 16 together.

The hinging elements 202, 204 are mounted to the vertical tubes 19 by a screw 218, tube fitting 220 and a spring washer 222 such as a Belleville spring washer. The tube fitting 220 is press fitted or staked into the vertical tube 19 and is formed with a threaded central bore 224. The spring washer 222 is placed over the tube fitting 220, so that its central bore 226 aligns with the threaded bore 224 of the tube fitting 220. The hinging elements 202, 204 are then placed together and atop the spring washer 222 so that their central bores 210, 212 are in alignment with bores 226, 224. The screw 218 is inserted through the hinging elements 202, 204 and spring washer 222, and then tightened in place within the threaded bore 224 of tube fitting 220.

Preferably, the screw 218 is tightened with approximately five inch-pounds of torque, so that if the upper and lower tubes 15, 17 are about two feet in length, for example, a force of about one and one-half to two and one-half pounds is required to pivot the hinging elements 202, 204 relative to one another. In this manner, the hinge means 200 provides enough resistance to hinging motion that a young child would not be able to pivot panels 13*a–f* apart, but at the same time an adult can readily position and fold panels 13*a–f*.

Figure 14:
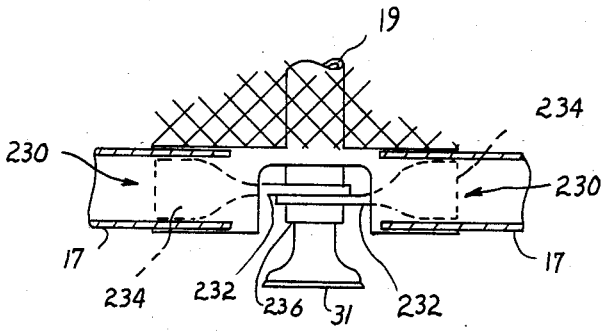
FIG. 14 is an enlarged front view of the base of the vertical tube of a panel, modified from that shown in FIG. 1*a*.

The connection of the horizontal lower tubes 17 to vertical panels 19 may also be modified as illustrated in FIG. 14. In this embodiment, injection molded plastic inserts 230 are formed with a hinging end 232 and a plug end 34. The hinging end 232 of each insert 230 is adapted to fit over and slidably pivot relative to the lower end of each vertical tube 19, and the plug end 234 is adapted to be press fitted or staked into the ends of the abutting lower tubes 17. The inserts 230 are held in place along vertical tubes 19 by a lock washer 236 or other suitable locking attachments. As in the embodiment shown in FIG. 1*a*, the inserts 230 are pivotal about vertical tubes 19 to permit articulation of panels 13*a–f* without the resistive effect on such movement as provided by the ratchet-type hinge means 200 connecting the upper tubes 15.

Although the invention has been described in terms of different embodiments, persons skilled in the art to which this invention pertains will readily appreciate other modifications and changes which may be made without departing from the spirit of the invention. For example, in several of the embodiments described above the mating hinging elements forming the hinge means of enclosure 11 are not identical. The upper tubes 15 of panels 13*a–f*, 14, 16 were assumed to include one hinging element at one end and the other at the opposite end. It should be understood that the upper tubes 15 could be formed with the same hinging element at each end, providing that panels 13*a–f*, 14, 16 having one type of hinging element are disposed adjacent those having the other mating hinging element. Therefore, we do not intend to be limited except by the scope of the appended claims.

Thus having described the invention, what is claimed is:

1. An adjustable enclosure comprising:

a plurality of inner panels and a pair of end panels each including horizontal upper and lower tubes disposed between spaced vertical tubes, each said panels having a mesh material extending between said horizontal and vertical tubes;

hinge means for pivotally connecting said inner panels and said end panels, said hinge means comprising:

a first hinging element having a stem portion adapted for insertion into an end of the upper horizontal tube of alternate inner panels, the other end of said first hinging element being formed with a radially ribbed surface offset from said stem portion;

a second hinging element having a stem portion adapted for insertion into an end of the upper horizontal tube of said inner panels disposed between said alternate inner panels, the other end of said second hinging element being formed with a radially ribbed surface offset from said stem portion, said radially ribbed surfaces of said first and second hinging elements being adapted to engage one another; and means for mounting said first and second hinging elements in pivotal relation to said vertical tube of each said panels including a tube insert insertable within said vertical tube and having a threaded bore, a spring washer disposed atop said tube insert and being formed with a central bore, and a screw insertable through said spring washer and into said tube insert, said radially ribbed surfaces of said first and second hinging elements being formed with a bore and being adapted to mount atop said tube fitting and said spring washer, whereby said screw is inserted through said first and second hinging elements and said spring washer and then tightened within said threaded central bore of said tube fitting with a torque of about five inch-pounds.

2. An adjustable enclosure comprising:

a plurality of inner panels and a pair of end panels each including horizontal upper and lower tubes disposed between spaced vertical tubes, each said panel having a mesh material extending between said horizontal and vertical tubes;

hinge means for pivotally connecting said inner panels and said end panels, said hinge means comprising:

a first hinging element having a stem portion adpted for insertion into an end of the upper horizontal tube of alternate inner panels, the other end of said first hinging element being formed with a radially ribbed surface offset from said stem portion;

a second hinging element having a stem portion adapted for insertion into an end of the upper horizontal tube of said inner panels disposed between said alternate inner panels, the other end of said second hinging element being formed with a radially ribbed surface offset from said stem portion, said radially ribbed surfaces of said first and second hinging elements being adapted to engage one another; and means for mounting said first and second hinging elements in pivotal relation to said vertical tube of each said panels including a tube insert insertable within said vertical tube and having a bore, a spring washer disposed atop said tube insert and being formed with a central bore, and a fastener insertable through said spring washer and into said tube insert for securement thereto, said radially ribbed surfaces of said first and second hinging elements being formed with a bore and being adapted to mount atop said tube insert and said spring washer, whereby said fastener is inserted through said first and second hinging elements and said spring washer to bias the first and second hinging elements against one another.

3. An adjustable enclosure comprising:

a plurality of inner panels and a pair of end panels each including horizontal upper and lower tubes disposed between spaced vertical tubes, each said panels having a mesh material extending between said horizontal and vertical tubes:

hinge means for pivotally connecting said inner panels and said end panels, said hinge means comprising:

a first hinging element formed with one end adapted for insertion into an end of the upper horizontal tube of said alternate inner panels, the other end of said first hinging element being formed with an upper and lower extension, each said extensions having an open center formed with circumferential serrations, said upper and lower extensions having a cut-out portion forming spaced edge sections extending inwardly to said open center;

a second hinging element formed with one end adapted for insertion into an end of the upper horizontal tube of said inner panels disposed between said alternate inner panels, the other end of said second hinging element including a single extension having an open center formed with circumferential serrations, said single extension having a cut-out portion forming spaced edge sections extending inwardly to said open center;

means for mounting said first and second hinging elements in pivotal relation to said vertical tube of each said panels; and means for releasably securing said end panels to one another.

4. The adjustable enclosure of claim 3 wherein said means for mounting said first and second hinging elements to said vertical tube of an alternate inner panel and said vertical tube of an inner panel disposed between said alternate inner panels comprises a ratchet link having serrations at each end and a pair of spaced bores, a pair of tube inserts adapted to be inserted within said vertical tubes, and fastening means, said upper and lower extensions of said first hinging element being placed over one end of said ratchet link with said bores of said extensions aligning with said bore in said ratchet link, and said upper and lower extensions of said second hinging element being placed over the other end of said ratchet link with said bores of said extensions aligning with said other spaced bore of said ratchet link, said fastening means extending into said upper and lower extensions of said first and second hinging elements, through said ratchet link and into said bores of said tube inserts to secure said first hinging element to said vertical tube of an alternate inner panel and said second hinging element to said vertical tube of an inner panel disposed between said alternate inner panels.

5. An adjustable enclosure comprising:

a plurality of inner panels and a pair of end panels each including horizontal upper and lower tubes disposed between spaced vertical tubes, each said panels having a mesh material extending between said horizontal and vertical tubes;

hinge means for pivotally connecting said inner panels and said end panels, said hinge means comprising:

a first hining element including a tube having one end adapted to be inserted into an end of the upper horizontal tube of said alternate inner panels, the other end of said first hinging element being formed with an upper and lower extension including aligning bores, said tube being formed with a cavity extending inwardly from said extensions, a spring insertable within said cavity, and a detect having an end adapted to engage said spring within said cavity, said detent being formed with a serrated edge at the other end;

a second hinging element including a tube having one end adapted to be inserted into an end of the upper horizontal tube of said inner panels adjacent said alternate inner panels, the other end of said second hinging element being formed with an upper and lower extension including aligning bores, said second hinging element being adapted to engage said first hinging element with said upper extension thereof extending over said upper extension of said first hinging element and said lower extension thereof extending below said lower extension of said first hinging element, said tube of said second hinging element being formed with a cavity, a spring insertable within said cavity, and a detent having an elongated portion engageable with said spring within said cavity, said detent being formed with a serrated edge at an end opposite said elongated portion;

means for mounting said first and second hinging elements in pivotal relation to said vertical tube of each said panels; and means for releasably securing said end panels to one another.

6. The adjustable enclosure of claim 5 wherein said means for mounting said first and second hinging elements in pivotal relation to said vertical tube of each said panel comprises a ratchet link having a serrated circumference and a central bore, a tube insert formed with a bore and adapted to be inserted within said vertical tube, and fastening means, said first and second hinging means being placed in engagement with said ratchet link disposed between said upper and lower extensions of said first hinging means such that said bore of said ratchet link aligns with said bores in said first and second hinging means, said fastening means extending through said bores in aid first and second hinging means and said bore of said ratchet link and into said bore of said tube insert for securing said first and second hinging means in pivotal relation to said vertical tube.

7. An adjustable enclosure comprising:

a plurality of inner panels and a pair of end panels each including horizontal upper and lower tubes disposed between spaced vertical tubes, each said panels having a mesh material extending between said horizontal and vertical tubes;

hinge means for pivotally connecting said inner panels and said end panels, said hinge means comprising:

a first hinging element formed at an end of the upper tube of alternate inner panels and at least one end panel;

a second hinging element formed at an end of the upper tube of said inner panels disposed between said alternate inner panels, said first and second hinging elements being formed with aligning bores;

means for mounting said first and second hinging elements in pivotal relation to said vertical tube of each said panels including tube fitting formed with a bore and adapted for insertion into said vertical tube, an end cap having a hollow stem inserted through said aligning bores of said hinging elements and into engagement with said tube fitting, a spring washer disposed between said end cap and said hinging elements, and a fastening means adapted to be inserted through said end cap, spring washer, hinging elements and into said bore of said tube fitting for rotatably securing said hinging elements to said vertical tube; and means for releasably securing said end panels to one another.

8. An adjustable enclosure comprising:

a plurality of inner panels and a pair of end panels each including horizontal upper and lower tubes disposed between spaced vertical tubes, each said panels having a mesh material extending between said horizontal and vertical tubes;

hinge means for pivotally connecting said inner panels and said end panels, said hinge means comprising:

a first hinging element formed with one end adapted for insertion into an end of the upper horizontal tube of alternate inner panels, the other end of said first hinging element being formed with an upper and lower extension, each said extensions having an open center formed with circumferential serrations, said upper and lower extensions having a cut-out portion forming spaced edge sections extending inwardly to said open center;

a second hinging element formed with one end adapted for insertion into an end of the upper horizontal tube of said inner panels disposed between said alternate inner panels, the other end of said second hinging element including a single extension having an open center formed with circumferential serrations, said single extension having a cut-out portion forming spaced edge sections extending inwardly to said open center;

means for mounting said first and second hinging elements in pivotal relation to said vertical tube of each said panels; and means for releasably securing said end panels to one another.

9. The adjustable enclosure of claim 8 wherein said upper tube of at least one of said end panels includes said second hinging element.

10. The adjustable enclosure of claim 8 wherein said upper tube of said end panels includes said first hinging element.

11. The adjustable enclosure of claim 8 wherein said upper tube of said end panels includes said second hinging element.

12. The adjustable enclosure of claim 8 wherein said first and second hinging elements are formed with aligning bores, said means for mounting said hinging elements in pivotal relation to said vertical tube of each said panel comprises a tube fitting formed with a central bore and a fastening means, said tube fitting having one end adapted for insertion into said vertical tubes and a serrated stud at the other end, said first and second hinging elements being adapted to engage said serrated stud with said spaced edge sections of said upper and lower extension of said first hinging element and said single extension of said second hinging element being urged apart to receive said stud within said open centers thereof, said single extension of said second hinging element being disposed between said upper and lower extensions of said first hinging element when positioned along said stud, said fastening means extending through said central bore of said tube fitting and into engagement with said upper extension of said first hinging element for securing said first and second hinging elements along said stud of said tube fitting and to said vertical tube.

13. An adjustable enclosure comprising:

a plurality of inner panels and a pair of end panels each having horizontal upper and lower tubes connected at each end to spaced vertical tubes, each said panels having a mesh material extending between said horizontal and vertical tubes;

hinge means for pivotally connecting said inner panels to one another and to said end panels, said hinge means comprising:

first and second hinging elements each including a pair of tubes, said tubes each having one end adapted to be inserted into an end of said upper tube of said inner panels, the other end of each said tubes being formed with an upper and lower extension having aligning bores formed therein, said tubes being formed with a cavity extending inwardly from said extensions, a spring being insertable within said cavity, and a detent having an end adapted to engage said spring within said cavity, said detent being formed with a serated edge at the other end;

means for mounting said first and second hinging elements in pivotal relation to said spaced vertical tubes of each said panels; and means for releasably securing said end panels to one another.

14. The adjustable enclosure of claim 13, wherein said inner panels include alternating inner panels and inner panels disposed between said alternating inner panels, said means for mounting said first ands second hinging elements to said vertical tube of said inner panels including a ratchet link having serrations at each end and a pair of spaced bores, a pair of tube inserts adapted to be inserted within said vertical tubes, and fastening means, said upper and lower extensions of said first hinging element being placed over one end of said ratchet link with said bores of said extensions aligning with said bore in said ratchet link, and said upper and lower extensions of said second hinging element being placed over the other end of said ratchet link with said bores of said extensions aligning with said other spaced bore of said ratchet link, said fastening means extensing into said upper and lower extensions of said first and second hinging elements, through said ratchet link and into said bores of said tube inserts to secure said first hinging element to said vertical tube of an alternate inner panel and said second hinging element to said vertical tube of an inner panel disposed between said alternate inner panels.

15. An adjustable enclosure, comprising:

a plurality of alternating inner panels and inner panels disposed between said alternating inner panels, said inner panels each including upper and lower horizontal tubes disposed between spaced vertical tubes;

a pair of end panels each having upper and lower horizontal tubes disposed between spaced vertical tubes;

hinge means for pivotally connecting said inner panels and said end panels, said hinge means comprising:

a first hinging element including a tube having one end adapted to be inserted into an end of said upper horizontal tube of said alternating inner panels, the other end of said first hinging element being formed with an upper and lower extension including aligning bores, said tube being formed with a cavity extending inwardly from said extensions, a spring insertable within said cavity, and a detent having an end adapted to engage said spring within said cavity, said detent being formed with a serrated edge at the other end;

a second hinging element including a tube having one end adapted to be inserted into an end of the upper horizontal tube of said inner panels between said alternating inner panels, the other end of said second hinging element being formed with an upper and lower extension including aligning bores, said seocnd hinging element being adapted to engage said first hinging element with said upper extension thereof extending over said upper extension of said first hinging element and said lower extension thereof extending below said lower extension of said first hinging element, said tube of said second hinging element being formed with a cavity a spring insertable within said cavity, and a detect having an end engageable with said spring within said cavity, said detect being formed with a serrated edge at the other end;

means for mounting said first and second hinging elements in pivotal relation to said vertical tube of each said panels; and means for releasably securing said end panels to one another.

16. The adjustable enclosure of claim 15 wherein said means for mounting said first and second hinging elements in pivotal relation to said vertical tube of each said panel comprises a ratchet link having a serrated circumference and a central bore, a tube insert formed with a bore and adapted to be inserted within said vertical tube, and fastening means, said first and second hinging means being placed in engagement with said ratchet link disposed between said upper and lower extensions of said first hinging means such that said bore of said ratchet link aligns with said bores in said first and second hinging means, said fastening means extending through said bores in said first and second hinging means and said bore of said ratchet link and into said bore of said tube insert for securing said first and second hinging means in pivotal relation to said vertical tube.

17. An adjustable enclosure comprising:

a plurality of inner panels and a pair of end panels, each of said inner panels and end panels including horizontal upper and lower tubes disposed between spaced vertical tubes, each said panels having a mesh material extending between said horizontal and vertical tubes;

hinge means for pivotally connecting said inner panels and said end panels, said hinge means comprising:

a first hinging element having a ribbed surface formed at an end of said upper tube of alternating inner panels and at least one end panel;

a second hinging element having a ribbed surface formed at an end of said upper tube of said inner panels disposed between said alternating inner panels, said ribbed surfaces of said first and second hinging elements being adapted to engage one another;

means for mounting said first and second hinging elements in pivotal relation to said vertical tube of each said end panels including a tube fitting formed with a bore and adapted for insertion into said vertical tube, an end cap having a hollow stem inserted through said aligning bores of said hinging elements and into engagement with said tube fitting, a spring washer disposed between said end cap and said hinging elements, and a fastening means adapted to be inserted through said end cap, spring washer, hinging elements, and into said bore of said tube fitting for rotatably securing said hinge elements to said vertical tube; and means for releasably securing said end panels to one another.

* * * * *